United States Patent [19]

Bellamy et al.

[11] 4,434,822

[45] Mar. 6, 1984

[54] SYSTEM FOR THE STERILE MIXING OF MATERIALS

[75] Inventors: David Bellamy, Kenilworth; Dale A. Smith, Barrington, both of Ill.

[73] Assignee: Baxter Travenol Laboratories, Inc., Deerfield, Ill.

[21] Appl. No.: 315,399

[22] Filed: Oct. 27, 1981

Related U.S. Application Data

[63] Continuation of Ser. No. 91,688, Nov. 5, 1979, abandoned.

[51] Int. Cl.[3] ..... B65B 3/04

[52] U.S. Cl. ..... 141/98; 141/114; 141/392; 222/80; 604/7; 604/48

[58] Field of Search ..... 141/1, 98, 114, 311 R, 141/392, 279, 382–386, 346–362, 285–310, 19, 329, 330; 128/214 R, 214.2, 247; 156/250–253, 261, 272, 289, 82, 304, 306; 285/31, DIG. 16; 222/80; 604/7, 48, 410–412

[56] References Cited

U.S. PATENT DOCUMENTS

| | | |
|---|---|---|
| 1,921,809 | 8/1983 | Crain . |
| 2,553,259 | 5/1951 | Hagedorn . |
| 2,622,053 | 12/1952 | Clowe et al. . |
| 2,668,364 | 2/1954 | Colton . |
| 2,744,432 | 12/1956 | Danziger . |
| 2,782,495 | 2/1957 | Augustauskas . |
| 2,839,788 | 6/1958 | Dembiak . |
| 2,903,004 | 9/1959 | Gerteis . |
| 2,910,083 | 10/1959 | Cook . |
| 3,023,762 | 3/1962 | Cook . |
| 3,214,502 | 10/1965 | Schaar . |
| 3,244,412 | 4/1966 | Robinson et al. . |
| 3,384,526 | 5/1968 | Abramson et al. . |
| 3,404,051 | 10/1968 | Hall . |
| 3,410,979 | 11/1968 | Larsson . |
| 3,493,002 | 2/1970 | Brugler et al. . |
| 3,549,451 | 12/1970 | Kugler . |
| 3,588,440 | 6/1971 | Morse . |
| 3,616,024 | 10/1971 | Windle . |
| 3,640,790 | 2/1972 | Rowley et al. . |
| 3,913,348 | 10/1975 | Magester . |
| 3,968,195 | 7/1976 | Bishop . |
| 3,997,385 | 12/1976 | Osborne . |
| 4,022,205 | 5/1977 | Tenczar . |
| 4,022,256 | 5/1977 | Berkman et al. . |
| 4,030,494 | 6/1977 | Tenczar . |
| 4,105,484 | 8/1978 | Newton et al. . |
| 4,157,723 | 6/1979 | Granzow et al. . |
| 4,177,372 | 12/1979 | Kotera et al. . |
| 4,265,280 | 5/1981 | Ammann et al. . |
| 4,325,417 | 4/1982 | Boggs et al. . |
| 4,340,097 | 7/1982 | Ammann et al. . |

FOREIGN PATENT DOCUMENTS

| | | |
|---|---|---|
| 801162 | of 0000 | United Kingdom . |
| 1027528 | 4/1966 | United Kingdom . |

OTHER PUBLICATIONS

"An Aseptic Fluid Transfer System to Maintain Blood Sterility" *DHEW Publication No. (NIH)* 76-1004, Berkman et al.

"Sterile Connector", *Transfusion,* Sep.-Oct. 1976, pp. 477–482, F. J. Tenczar.

"An Aseptic Fluid Transfer System for Blood and Blood Components", Transfusion, Sep.-Oct. 1978, B. A. Myhre et al.

*Primary Examiner*—Houston S. Bell, Jr.

*Attorney, Agent, or Firm*—Paul C. Flattery; Garrettson Ellis; Daniel D. Ryan

[57] ABSTRACT

A fluid transfer assembly includes first and second connector members, each associated with a fluid conduit and having a meltable wall which normally seals the connector member, and thus the associated conduit. The connector members can be coupled together, with the meltable walls positioned in facing contact. One of the meltable walls includes a radiant energy absorbing material. The other meltable wall is relatively non-absorbant of radiant energy, but does conduct heat energy. By exposing the coupled assembly to a source of radiant energy, the one wall melts in response to thermal radiation, while the other wall conducts heat energy from the melting wall to also melt. By melting, the walls open a fluid path between the fluid conduits.

3 Claims, 8 Drawing Figures

SYSTEM FOR THE STERILE MIXING OF MATERIALS

This is a continuation of application Ser. No. 091,688, filed Nov. 5, 1979, now abandoned.

BACKGROUND OF THE INVENTION

In parenteral solution therapy, supplemental medication is often added to the patient along with the bulk solutions. This may be conveniently done, for example, by means of the ADD-A-LINE and the CONTINU-FLO sets for parenteral solution administration sold by Travenol Laboratories, Inc. of Deerfield, Ill., and described, for example, in U.S. Pat. Nos. 4,034,754 and 4,105,029.

Accordingly, materials such as antibiotic may be administered at the physician's option on an intermittent basis during intravenous solution treatment by means of a connection into the main intravenous solution line communicating with the venous system of the patient, or on a continuous basis by addition to the bulk solution.

In a large hospital operation, it of course would be desirable to have the supplemental medicament materials ready in their liquid, diluted form for immediate administration at the option of the physician. However, many of these materials must be stored in the dry form until immediately before use, particularly because of the danger of contamination through bacterial growth, or lack of pharmaceutical stability, which may result when the liquid or dry medicament is mixed or reconstituted by adding a diluent a substantial period of time before its administration.

In accordance with this invention, a sterile system is provided in which liquid or dry medicament materials or the like may be mixed or reconstituted with a sterile diluent at a convenient time substantially prior to the time of use, while at the same time retaining the reliable, sterile seal of the system so that multiplication of bacteria in the system is not a problem. As a result of this, fluid or dry medicaments and the like can be mixed or reconstituted with diluent in a hospital pharmacy, for example, at a convenient slack period time, and stored for uses on future date. Then, when the medicament is needed, it is ready in liquid form for immediate use without having to go through the time-consuming effort of reconstituting the material with diluent at the time when it is needed.

DESCRIPTION OF THE INVENTION

A connector member comprises transparent housing means, and a thermoplastic, opaque wall portion positioned as part of the wall of the housing means. Means for connecting the housing means to a housing means of another connector member having a corresponding thermoplastic wall portion are provided so that the connection may be made between the housings in such a manner as to bring the respective thermoplastic wall portions together into facing contact.

As the result of this, upon exposure of the connected housings to radiant energy, the thermoplastic wall portions in facing contact can fuse together and open an aperture through said opaque wall portion, to provide a connection between the interiors of the respective housings.

The inventive principle of the sterile connector means which is utilized in this invention is as described in the Granzow, et al. U.S. Pat. No. 4,157,723 which is incorporated herein by reference, as well as the Ammann et al, U.S. Pat. No. 4,265,280 Boggs et all U.S. Pat. No. 4,325,417.

The principle utilizes the concept, as described therein, that the transparent sealed housings permit the passage of radiation such as visible light or infrared radiation, while the abutting, opaque membranes absorb the infrared radiation and heat to their melting or softening point, whereby the two thermoplastic wall portions fuse together and form an aperture by the flow of molten material of the membrane so that the two membranes seal together about the aperture into a common mass.

While it is presently preferred for both of the thermoplastic wall portions to be opaque to the particular radiant energy used, it is contemplated as an alternative technique for only one of the thermoplastic portions to be opaque, while the other thermoplastic wall portion of the housing means of another connector member may be transparent. In fact, such a housing means of the other connector, carrying a transparent, thermoplastic wall portion, could in some circumstances be opaque in its own right, with the hole-opening function between the abutting thermoplastic wall portions being effected by the absorption of radiant energy by the opaque, thermoplastic wall portion through the transparent housing, with conduction of heat from the opaque wall portion to the abutting transparent thermoplastic will portion.

It is generally currently preferred to select a predominantly crystalline plastic materia. for the thermoplastic wall portions as described in the above-cited Boggs, et al. patent application, for example, a carbon-filled poly(4-methyl-1-pentene) which is sold under the name TPX by Mitsui Chemical Company. Such materials may preferably have a cystalline melting point of above 200° C.

Accordingly, the fusing and hole-opening step can provide indication that the walls of the newly-formed aperture through the abutting opaque membranes have been exposed to a sterilizing temperature, giving a highly reliable indication of the formation of a sterile connection.

Figure 3:
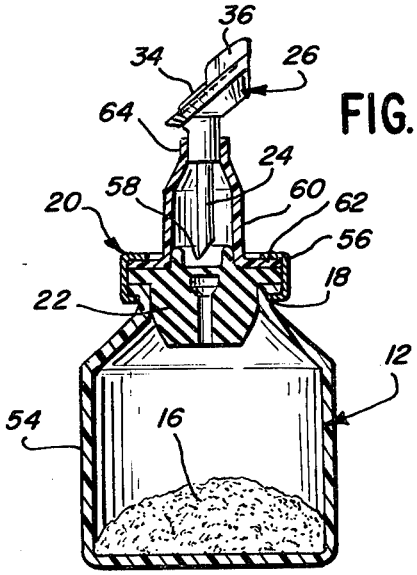
FIG. 3 is a vertical sectional view of one embodiment of a vial which may be utilized in accordance with this invention in the connected system of FIG. 1.
Figure 4:
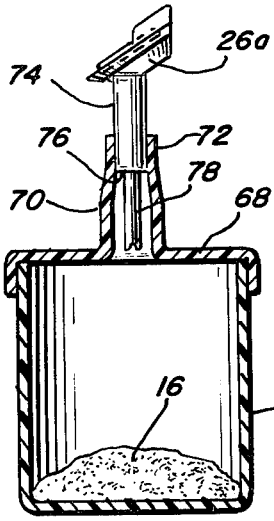
Figure 5:
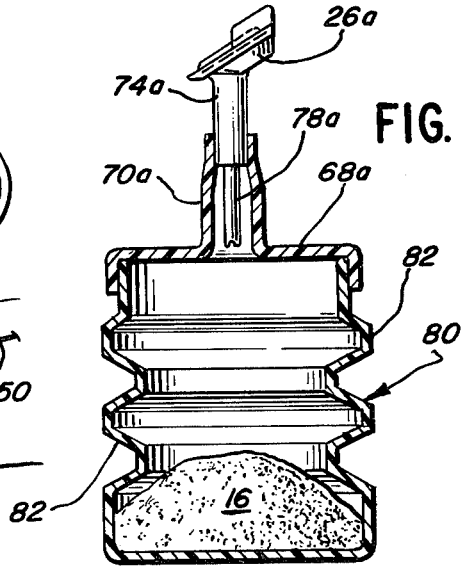
Figure 6:
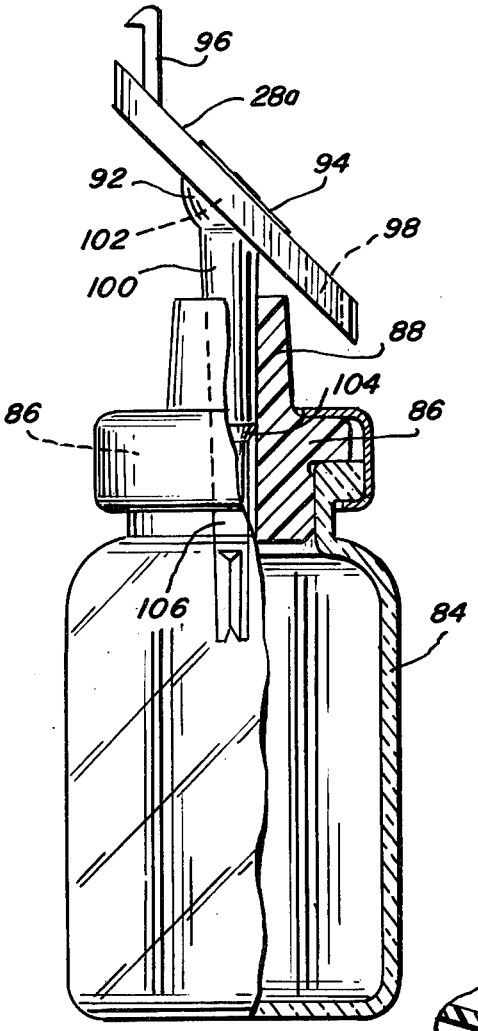
Figure 8:
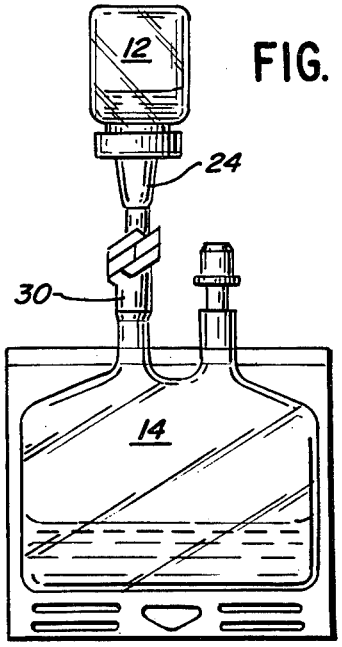
Figure 7:
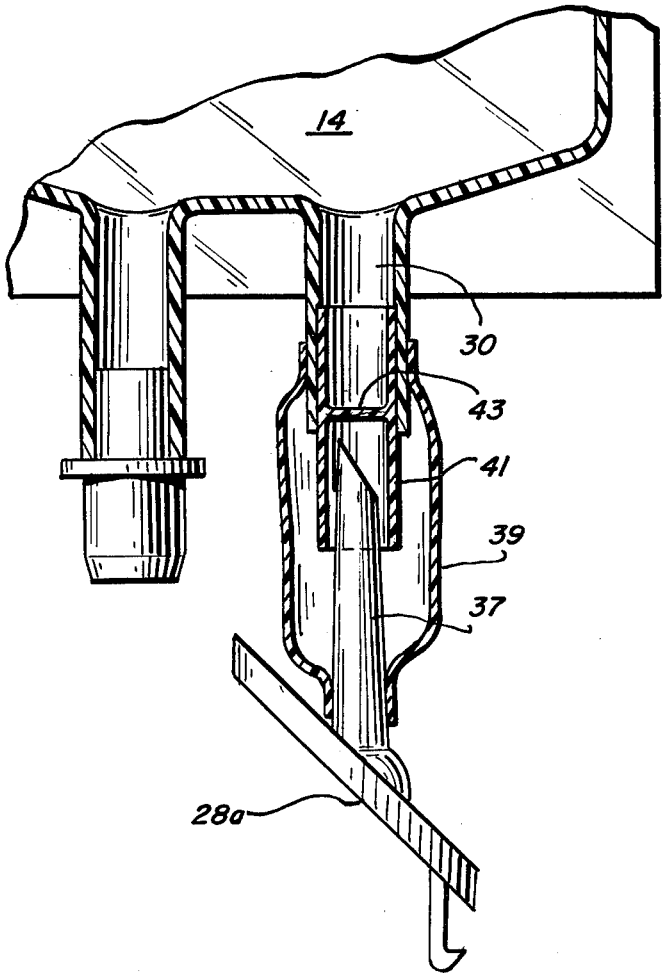

FIGS. 4, 5 and 6 are vertical sectional views showing alternative embodiments of vials which may be used as a substitute for the vial of FIG. 3. FIG. 7 is a detailed, fragmentary elevational view of a bag similar to FIG. 1, but using the connector of FIG. 4. FIG. 8 is a perspective view showing how the closed system of FIG. 1 may be manipulated after opening of the connection between the two containers shown to remove liquid from container 12.

Figure 1:
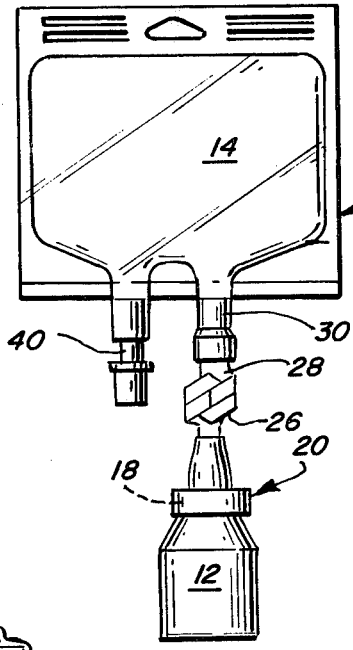
FIG. 1 is an elevational view of a supplemental medication administering system in accordance with this invention, in which a vial and a flexible, collapsible container are linked together in sterile connection.

Referring to the drawings, FIG. 1 shows a supplemental medication administering system 10 in which a vial 12 is provided in sterile connection with a flexible, collapsible container 14, which may be generally similar in construction to the MINI-BAG plastic container sold by Travenol Laboratories, Inc., of Deerfield, Ill., modified as described herein. Vial 12, on the other hand, may be similar to conventional dosage ampules except for the modifications described below.

Vial 12 may typically contain a liquid or solid medicament material 16, and may further define a closure 20 for sealingly occluding mouth portion 18. Closure 20 may further include a latex needle-piercable stopper 22 (FIG. 3), and may carry in sealed manner a conduit member 24 which includes at its outer end a connection member 26 for providing sealed connection between itself and a corresponding connector member 28, which is carried on the end of conduit 30 in sealed relation with collapsible bag 14.

Connector members 26, 28 may be of a design as specifically described in U.S. Pat. No. 4,157,723, or the Ammann, et al. or Boggs et al U.S. Patents previously cited, each preferably comprising a transparent housing means 32, and a thermoplastic, opaque wall portion 34, positioned as part of the wall of the housing means 32. Connecting means 36 are provided for connecting the respective connectors 26, 28 together, with the respective opaque walls 34 being brought together into facing contact.

Accordingly, sterile connection is achieved as previously described by exposing the connected housings to radiant energy such as infrared radiation, so that the opaque wall portions in facing contact can fuse together and open an aperture through the opaque wall portions to provide a sterile connection between the interiors of the respective housings without disconnection thereof. This provides of course a connection between containers 12 and 14, permitting diluent, for example, in bag 14 to flow into contact with the solid, dry material 16 of vial 12. The system may be agitated by shaking without opening, and then the liquid contents, carrying dissolved or suspended material 16, may be allowed to flow back into bag 14. If the contents 16 are liquid, they can directly flow into bag 14.

In accordance with this invention, one of the wall portions 34 includes an opaque material, which absorbs the radiant energy so that, in response to exposure to the radiant energy source, it is heated to its melting point to open the associated connector member 26 or 28. The other one of the wall portions 34 consists essentially of a material which is transparent to and therefore permits the passage of the radiant energy. However, while the one wall portion is being heated to its melting point by exposure to the radiant energy source, the other wall portion conducts heat energy from the one melting wall portion to be concurrently heated to its melting point to also open the associated other connector member 26 or 28.

Conduit member 24, carried by connector member 26, may carry a sharpened point or spike 58 at its end so that, after connection and opening between connector members 26, 28 has been made, a further connection between the contents of the vial 16 can be opened by the point 58 penetrating through stopper 22.

Correspondingly, as shown in FIG. 7, connector member 28*a*, mounted on bag 14, may correspondingly carry a hollow pointed spike member 37, which, in turn, is connected to conduit 30 of bag 14, by means of a flexible, tubular boot member 39.

Positioned within conduit 30 is a tubular member 41 which carries a needle-piercable diaphragm 43. Accordingly, after the sealed connection has been made between connector member 28*a* and another connector member on a vial such as vial 12, spike member 37 may be advanced to penetrate diaphragm 43, which is possible because of the presence of flexible boot 39, so that an open channel is formed between the inside of vial 12 and the interior of bag 14.

Alternatively, spike member 37 and diaphragm 43 may be replaced, if desired, by a breakaway projecting member extending outwardly from a closed end of a tubular structure analogous to spike member 37, in a manner similar to that shown in FIG. 4.

Following this, flexible tubing 30, which may be made of a heat sealable material such as polyvinyl chloride plastic, may be clamped or preferably heat sealed to provide a sealed end 38 to bag 14, and the tubing 30 outside of the sealed end may be severed to get rid of vial 12 and the connectors 26, 28. At this point, the contents of bag 14 remain reliably sterile, and may be stored for a period of time which is considerably lower than in the case where a conventional, aseptic connection between containers 12 and 14 has been made.

Figure 2:
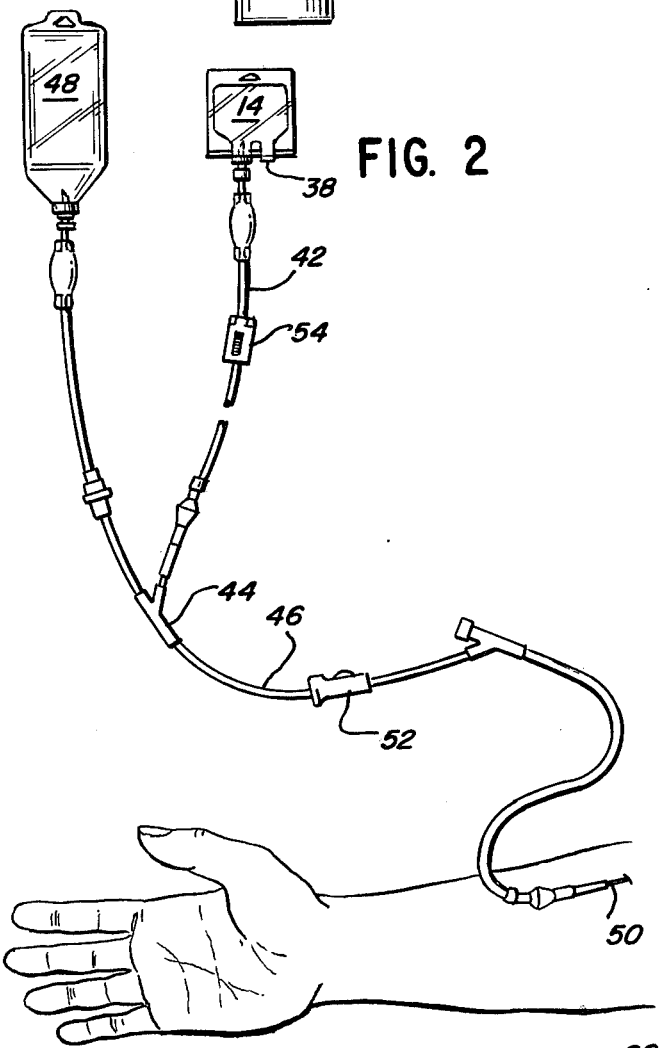
FIG. 2 is an elevational view showing how the flexible collapsible container of FIG. 1, after having dissolved and received the dry, solid contents of the vial, may be connected to a supplemental medication administration set positioned in connection with a conventional administration set for parenteral solution.

When the time arrives for use of the liquid contents, containing the material 16 such as a powdered antibiotic, an aseptic connection may be made through added conventional sealed port 40 in bag 14 by means of supplemental medication set 42, for example, which may be of the type previously described and sold by Travenol Laboratories, Inc. Supplemental medication set 42 may, in turn, be connected to a Y-site 44 of an appropriate administration set 46 such as the ADD-A-LINE set described above. The set may be connected with a conventional parenteral solution container 48; the set primed; and the set needle 50 may be inserted into the venous system of the patient as shown in FIG. 2.

By this technique, conventional parenteral solution administration may be provided to the patient by appropriate adjustment of roller clamp 52.

In use, flexible container 14 is generally set at a vertically higher level than container 48. Accordingly, when clamp 54 is opened, the contents of container 14 preferentially flow into set 46, and into the patient's venous system through needle 50, for immediate administration of supplemental medication. When the contents of bag 14 are exhausted, or clamp 54 is closed, the normal flow of liquid from parenteral solution container 48 may be resumed.

Turning to the details of vial 12, the generally rigid bottle member 54 shown in FIG. 3 includes, as stated, the puncturable resealable stopper means 22 retained in mouth portion 18 by a ring retention means 56, comprising a crimped metal ring of conventional design.

Conduit member 24 is defined in part by a rigid, tubular cannula which, in turn, defines an inwardly-pointed spike 58 adapted to penetrate puncturable stopper means 22. A flexible boot member 60 is sealed to the mouth 18 of the vial 12 at one end 62, by clamping action as shown on the part of ring retention means 56. At its other end, boot 60 is sealed to cannula 24 at area 64.

Boot 60 is made of a flexible, elastomeric material so that cannula 24 may be manipulated upwardly and downwardly to cause pointed end 58 to penetrate stopper 22, for communication of cannula 24 with the interior of vial 12 in aseptic manner.

Turning to FIG. 4, another embodiment of the vial of this invention is disclosed. Body 66 of the vial of FIG. 4 may be self-supporting in its shape, but sufficiently resilient to be manually collapsible to assist in the expulsion of the contents within body 66. Additionally, the body 66 may have sufficient plastic memory to tend to spring out again into its original shape after manual collapse, if desired, so that the container is capable of exerting gentle suction, for facilitating the filling of body 66 with a diluent or the like.

A semi-rigid closure member 68 is sealed to the open end of cup-like body 66 as shown, and defines a flexible tube 70 which is sealed at its outer end 72 to a conduit member 74 in accordance with this invention. The outer end of conduit member 74 may be integrally attached to a connector member 26*a* of similar or identical design to connector member 26 previously described.

At its other end from the connector member 26*a*, conduit member 74 defines a closed end wall 76, sealed within tubing 70, so that its inner end is in communication with the interior of body 66 of the vial of FIG. 4. Means for rupturing the conduit member 76 are provided, which may constitute a structure similar to the Bayham U.S. Patent cited above.

Projecting member 78 extends outwardly from closed end wall 76 of conduit member 74. Tubing 70, constituting part of the closure of the mouth portion of the vial 66 is sufficiently resilient to permit manual bending of projecting member 78 to cause rupture of the end wall 76, to permit the opening of conduit member 74, providing communication between the interior of connector 26*a* and vial 66.

Turning to FIG. 5, a vial comprising a flexible body 80 is disclosed, in which the flexible body 80 defines a plurality of bellows-like convolutions 82 so that the vial may be manually collapsed by flexing of the convolutions and will tend to spring back to its normal configuration, exerting suction for assisting and receiving diluent solution from another container, or the like.

As is the embodiment of FIG. 4, a closure member 68*a* is provided, being sealed to the mouth of vial body 80 as shown. The remaining parts including conduit 74*a*, tubing 70*a*, projecting member 78*a* and connector member 32*a*, may be identical in structure and function to the corresponding parts of FIG. 4.

Referring to FIG. 6, a vial 84, which may be a conventional rigid glass vial, for example, may contain a rubber stopper 86 as shown, which carries a vertically upstanding rubber sleeve 88 as an integral part of the stopper. Connector member 28*a* defines a transparent housing 92, having an opaque thermoplastic wall member 94 having a function similar to the previous connector members. Bayonet 96 and aperture 98 are proportioned to lockingly fit in the corresponding aperture and bayonet of a similar housing, for sterile connection in accordance with the principles previously described.

Conduit 100 communicates at one end with the chamber 102 which is partially defined by the inner surface of opaque wall member 94. At the other end of conduit 100 an end wall 104 is defined, and a projecting member 106 projecting out from wall 104 and rupturable by bending to open wall 104 in a manner similar to that described with respect to members 78 and 78*a* in FIGS. 4 and 5.

Accordingly, this vial may be opened, typically after connection of connector member 28*a* with mating connector member, attached, for example, to a bag similar to bag 14, by laterally bending connector member 90. Connector member 28*a* can flex laterally because of the presence of sleeve 88, to snap away projecting member 106 by impingement with the inner wall of the vial 84. Projecting member 106 then falls to the bottom of the vial.

After opening of all of the corrections between the vial (such as vial 12 or any of the other vials shown) and bag 14, for example, the flexible bag 14 may be positioned in the vertical position as shown in FIG. 1, and manually squeezed to force some of the liquid contents of the bag 14 through the connection into vial 12. Upon release of manual squeezing, bubbles of air or other gas in vial 12 which is compressed by the influx of the liquid move upwardly through the connection into bag 14. Another squeeze of the bag 14 provides more liquid, until the desired amount of liquid is transferred. This technique may be used in the instance where the contents of the vial connected to bag 14 are solid.

The vial 12 (or other embodiment thereof) may then be shaken to dissolve the solid contents. The bag and vial system may then be inverted to the position as shown in FIG. 8. In the event that the liquid contents of the vial do not readily flow into bag 14 in a spontaneous manner, bag 14 may be squeezed again to force air or other gas in the bag into vial 12. The air bubbles rise to the top of the vial, and upon release of the pressure on bag 14, the compressed air in vial 12 forces some of the liquid 110 in the vial downwardly back into bag 14. Repeated application of pressure to bag 14 causes more air to pass into vial 12 under pressure, and, upon release, the pressurized air forces more of the liquid out until the vial 12 is empty.

Thereafter, tubing 30 may be heat-sealed and severed as described previously, and bag 14 may be placed into storage for ultimate use.

The above technique for transferring liquid to and from the bag and the vial requires certain dimensional characteristics of the double container system, or the solid and liquid contents will not be completely removable from the vial 12 in the closed system.

The parameters of the closed system shown in FIGS. 1 and 8 therefore preferably meet the following conditions: the air volume (which is intended to include any other gas present) in bag 14 and vial 12 (which is intended to include any design of vial used) must exceed the liquid volume of bag 14, plus the combined total internal volume of conduits 30 and 24, being the entire volume of the connection flow path for fluids between bag 14 and vial 12. Furthermore, the air volume of vial 12 must exceed the combined total internal volume of conduits 30 and 24, including the internal volumes of connectors 26, 28.

It is to be understood, of course, that in the specific instance of FIG. 3, the volume of conduit 24 does not include the volume within boot 60 but outside of tubular conduit member 24, since conduit member 24 is positioned in sealed relation within stopper 22.

Under the above conditions, when one of the containers such as bag 14 is compressible and the other of the containers is such as vial 12 is non-expansible, the above conditions provide a joined container system in which the contents of non-expansible container 12 can be completely removed by, in effect, pumping liquid out of container 12, or from container 14 into container 12 and then back out again.

Accordingly, this invention provides a means whereby the sterile contents of a vial may be brought into contact with a diluent or other ingredient of a formulation which is desirably mixed without a breach of sterility. By this invention, the reliability of sterility is so high that sensitive materials may be stored for a substantial period of time following the mixing, when such would not be advisable if merely normal aseptic techniques were followed. After such storage, the contents may be administered in any manner desired for any use in or out of the medical field, using one or more of the connected containers as shown herein, or equivalent structures.

It is also contemplated that vials may be utilized having more than one sterile connector system attached thereto, for connection with a multiplicity of other containers of various types as may be warranted by the situation.

The above has been offered for illustrative purposes only, and is not intended to limit the invention of this application, which is as defined in the claims below.

That which is claimed is:

1. In a fluid transfer assembly usable to interconnect and establish a fluid path between two locations, the transfer assembly being of the type having a first fluid conduit including at one end thereof a first connector member having first meltable wall means for normally sealing said first connector member, and thus said associated conduit end, from the exterior, a second fluid conduit including at one end thereof a second connector member having second meltable wall means for normally sealing said second connector, and thus said associated conduit end from the exterior, and means for coupling said first and second connector means together with said first wall means held in facing contact with said second wall means while the coupled assembly is exposed to a source of radiant energy, the improvement comprising one of said wall means includes a material which absorbs a sufficient quantity of the radiant energy so that, solely in response to its exposure to the radiant energy source, said one wall means is heated to its melting point to open said associated connector member, and the other one of said wall means consists essentially of a material which, while said one wall means is being heated to its melting point by exposure to the radiant energy source, does not absorb a sufficient quantity of the radiant energy to melt said other wall means but which does conduct a sufficient quantity of heat energy from said one wall means during melting thereof to concurrently heat said other wall means to its melting point to also open said associated connector member, whereby, during exposure of the coupled assembly to the radiant energy source, both of said wall means are opened by melting, one in response to thermal radiation and the other in response to thermal conduction, to open a fluid path between said fluid conduits.

2. In a A fluid transfer assembly according to claim 1 wherein the first and second connector members each includes a body which is adapted for attachment to the associated conduit and to which said respective wall means is attached, and wherein said improvement further comprises only one of said bodies being made of a material which, compared to said material of said one wall means, is relatively non-absorbant of radiant energy to permit, while the coupled assembly is exposed to the source of radiant energy, the passage of radiant energy from the source to said one wall means, the other one of said bodies being made of a material which, like said material of said one wall means, absorbs the radiant energy.

3. A fluid transfer assembly according to claim 1 or 3 wherein both of said wall means have a crystalline melting point above 200° C.

* * * * *